US006009865A

United States Patent [19]

Herndon et al.

[11] Patent Number: 6,009,865

[45] Date of Patent: Jan. 4, 2000

[54] LOW SPEED IGNITION SYSTEM

[75] Inventors: James A. Herndon, Cass City; Matthew L. Werner, Caro, both of Mich.

[73] Assignee: Walbro Corporation, Cass City, Mich.

[21] Appl. No.: 09/162,980

[22] Filed: Sep. 23, 1998

[51] Int. Cl.[7] ..... F02P 15/12

[52] U.S. Cl. ..... 123/601

[58] Field of Search ..... 123/599, 600, 123/601, 603, 597, 598, 604, 620

[56] References Cited

U.S. PATENT DOCUMENTS

| | | | |
|---|---|---|---|
| 3,911,887 | 10/1975 | Burson | 123/601 |
| 4,699,115 | 10/1987 | Terada et al. | 123/604 |
| 5,392,753 | 2/1995 | Burson et al. | 123/600 |
| 5,630,384 | 5/1997 | Mottier et al. | 123/620 |

FOREIGN PATENT DOCUMENTS 4-175466 6/1992 Japan .

*Primary Examiner*—Andrew M. Dolinar
*Attorney, Agent, or Firm*—Reising, Ethington, Barnes, Kisselle, Learman & McCulloch, P.C.

[57] ABSTRACT

A capacitor discharge type ignition system for an internal combustion engine has a secondary charge coil mounted on a ferromagnetic core adjacent to a primary charge coil and an ignition coil, and means for selectively providing current from a battery to the secondary charge coil to increase the charging of a capacitor with the fly back voltage of the secondary charge coil when the current supplied to it from the battery is interrupted or terminated to increase the charge stored by the capacitor at low engine speeds and thereby facilitate starting an engine at very low engine speeds. The battery provides additional energy necessary to provide ignition and starting of the engine at very low engine speeds and can also be used to provide power for other functions, such as to electric starting of the engine, or to power other auxiliary features of the machine powered by the engine. Advantageously, the secondary charge coil is not regulated and excess power discharged from the secondary charge coil is directed to the battery to recharge the battery and maximize its life.

11 Claims, 5 Drawing Sheets

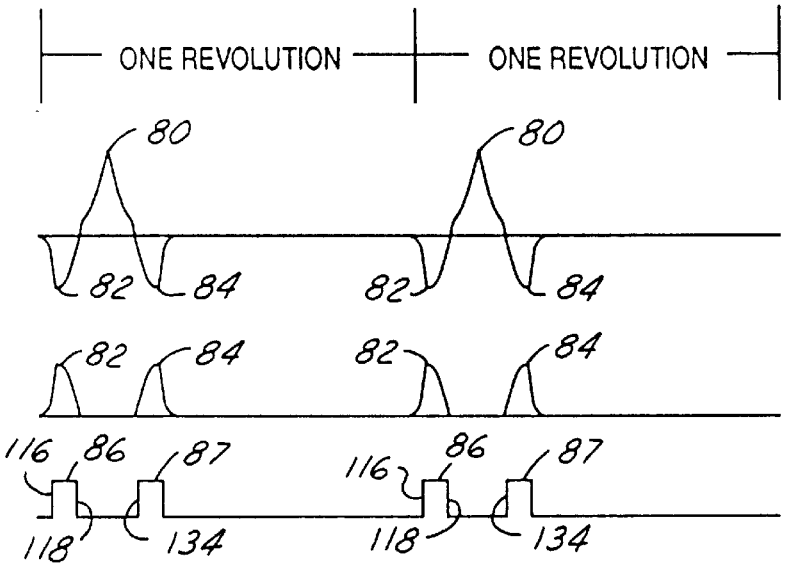
FIG.3A
FIG.3B
FIG.3C
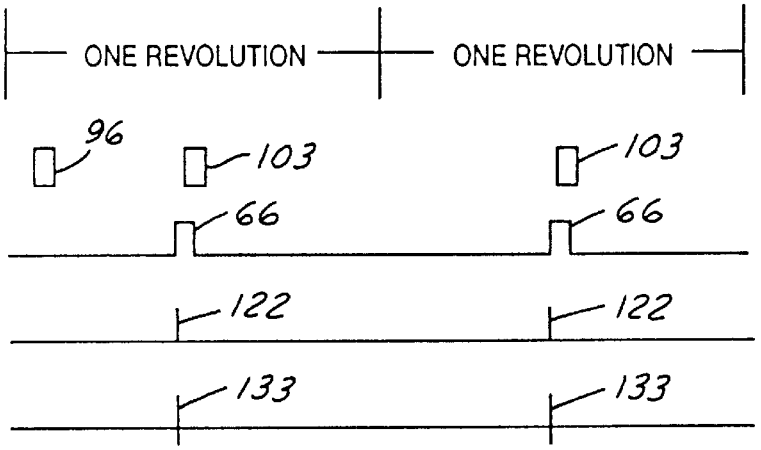
FIG.4A
FIG.4B
FIG.4C
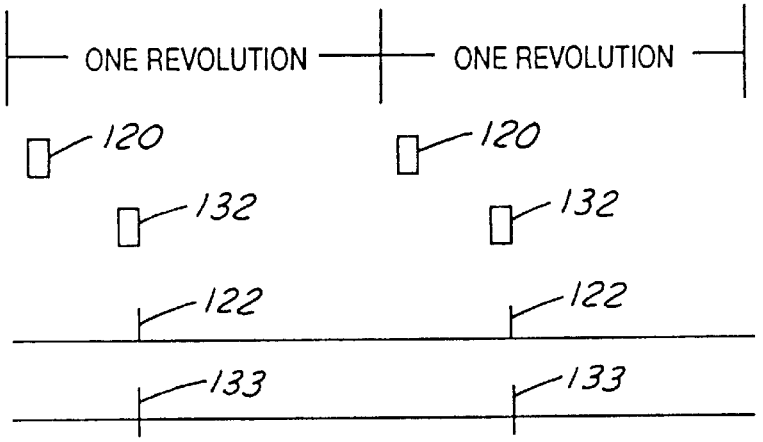
FIG.5A
FIG.5B
FIG.5C

LOW SPEED IGNITION SYSTEM

FIELD OF THE INVENTION

This invention relates generally to ignition systems and more particularly to a capacitor discharge-type ignition system for internal combustion engines.

BACKGROUND OF THE INVENTION

Capacitor discharge-type ignition systems have been used to start spark ignited internal combustion engines. Generally, these ignition systems have a stator assembly with an ignition coil having primary and secondary windings and a charge coil received around a ferromagnetic core. A permanent magnet assembly mounted on a flywheel of the engine generates pulses within the charge coil as the permanent magnet is rotated past the ferromagnetic core. The current pulses produced in the charge coil are used to charge a capacitor which is subsequently discharged through the primary winding to induce a current in the secondary winding sufficient to cause a spark across a spark gap of a spark plug to ignite a fuel and air mixture within an engine cylinder combustion chamber to power the engine.

Examples of capacitor discharge type ignition systems are disclosed in U.S. Pat. No. 5,392,753 and U.S. Pat. No. 3,911,887. In these systems, a somewhat high engine speed must be obtained before sufficient current pulses are generated in the charge coil and transferred to the capacitor to charge the capacitor sufficiently such that when discharged, a spark is generated across the spark gap of a spark plug. Thus, these prior ignition systems have a relatively high minimum rotary speed at which the ignition system will produce a spark in the gap of the spark plug to start the engine.

SUMMARY OF THE INVENTION

A capacitor discharge type ignition system for an internal combustion engine has a secondary charge coil mounted on a ferromagnetic core adjacent to a primary charge coil and an ignition coil, and means for selectively providing current from a battery to the secondary charge coil to increase the charging of a capacitor with the fly back voltage of the secondary charge coil when the current supplied to it from the battery is interrupted or terminated to increase the charge stored by the capacitor at low engine rotary speeds and thereby facilitate starting an engine at very low engine cranking rotary speeds. The battery provides additional energy necessary to provide ignition and starting of the engine at very low engine speeds and can also be used to provide power for other functions, such as electric starting of the engine, or to power other auxiliary features of the machine powered by the engine. Advantageously, the secondary charge coil is not regulated and excess power discharged from the secondary charge coil is directed to the battery to recharge the battery and maximize its life.

Objects, features and advantages of this invention include providing a capacitor discharge ignition system which improves starting of an engine, permits starting the engine at low engine cranking speed, provides a battery which may be used to power auxiliary functions, recharges the battery to extend its life, is of relatively simple design and economical manufacture and assembly and in service has a long, useful life.

BRIEF DESCRIPTION OF THE DRAWINGS

These and other objects, features and advantages of this invention will apparent from the following detailed description of the preferred embodiments and best mode, appended claims and accompanying drawings in which:

FIGS. 3A, 3B and 3C are plots of wave forms of the type generated in the operation of the ignition system of FIG. 2;

FIGS. 4A, 4B and 4C are plots of various pulses and control signals generated during operation of the system of FIG. 2 during the first two revolutions of an engine as it is started;

FIGS. 5A, 5B and 5C are plots of pulses and control signals generated during operation of the ignition system of FIG. 2 during two revolutions of the engine when it is operating at a relatively high speed;

DETAILED DESCRIPTION OF THE PREFERRED EMBODIMENTS

Figure 1:
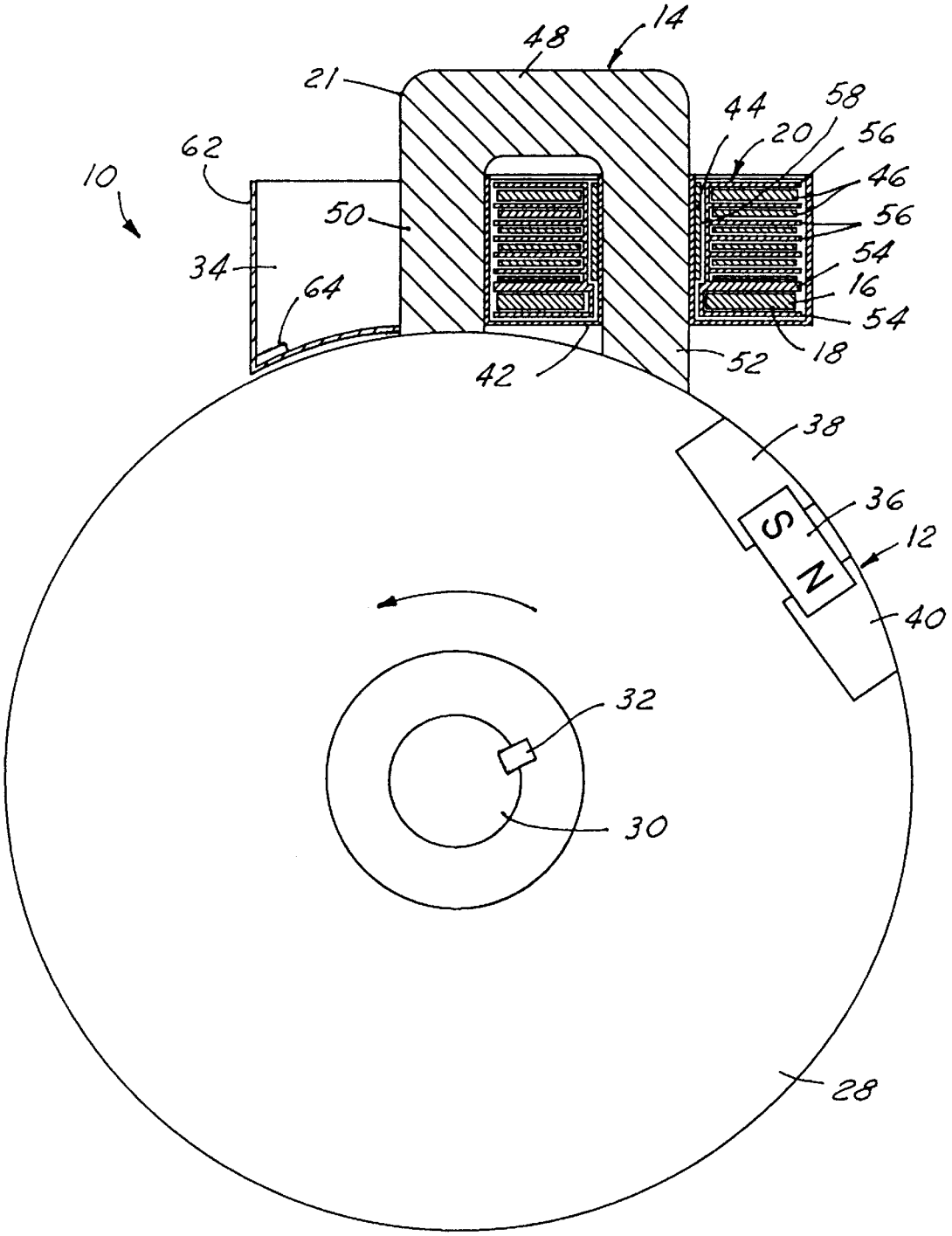
FIG. 1 is an elevational view with parts in section of a capacitor discharge ignition system embodying this invention and having a stator assembly mounted adjacent to and a permanent magnet assembly mounted on a flywheel of an engine.
Figure 2:
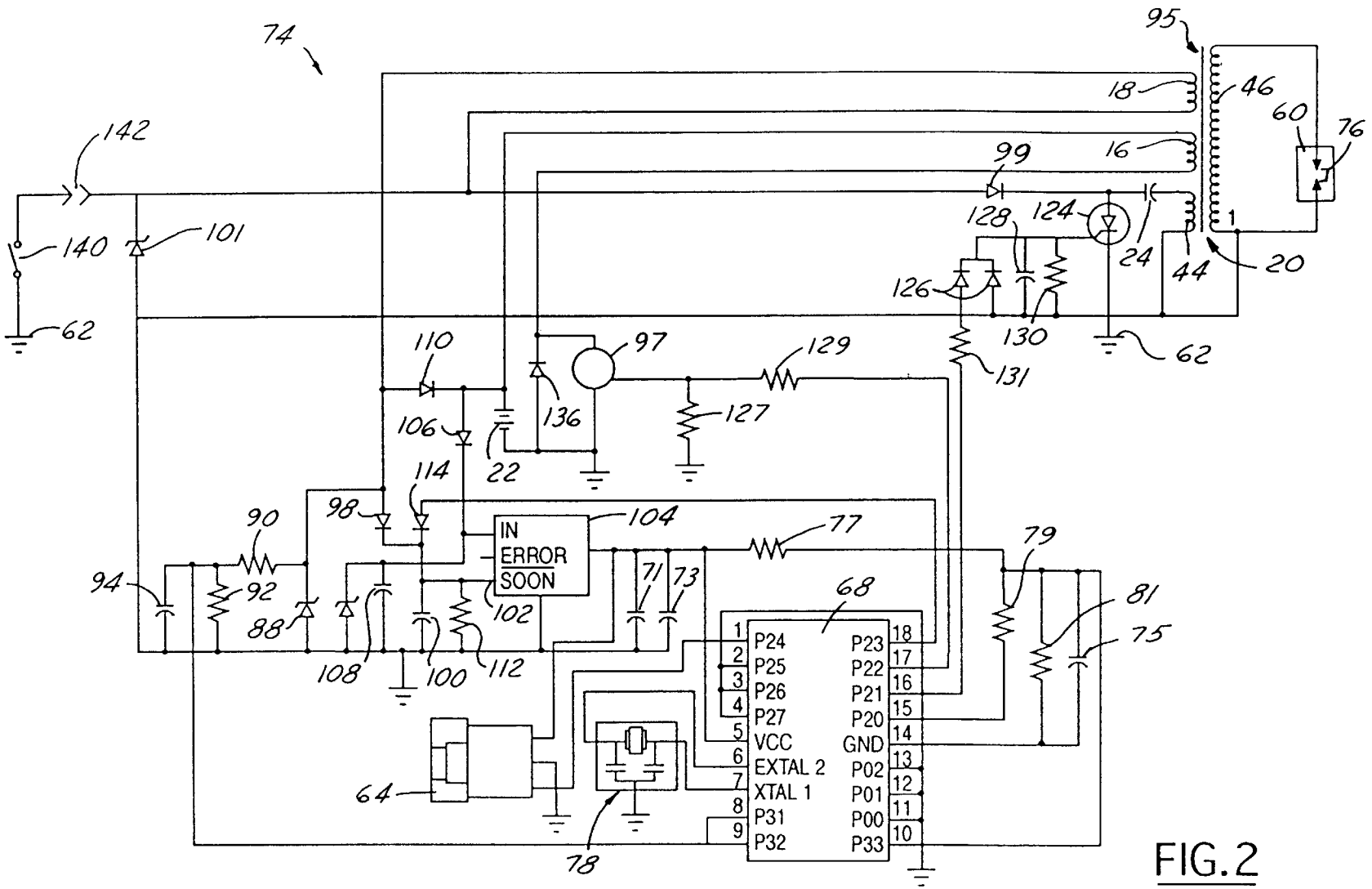
FIG. 2 is a schematic diagram of an ignition system embodying the invention.

Referring in more detail to the drawings, FIGS. 1 and 2 illustrate an ignition system 10 embodying this invention which enables starting an engine at a very low cranking rotary speed. The system 10 has a permanent magnet assembly 12, a stator assembly 14 and associated circuitry. The stator assembly 14 has a secondary charge coil 16 adjacent to a primary charge coil 18 and an ignition coil 20 all received on a ferromagnetic core 21. At low engine rotary speed, the circuitry selectively provides current from a battery 22 to the secondary charge coil 16 to increase the charging of an ignition capacitor 24 by the fly back voltage of the secondary charge coil 16 when the current supplied to it from the battery 22 is interrupted or terminated to increase the charge stored by the capacitor 24 at low engine speeds and thereby facilitate starting the engine at very low engine speeds.

The permanent magnet assembly 12 is disposed on a flywheel 28 which in turn is attached to and rotatable in unison with a shaft 30, such as a crankshaft or camshaft, of an internal combustion engine. The permanent magnet assembly 12 is located at a predetermined angular position relative to a key 32 on the shaft 30 which couples the shaft 30 to the flywheel 28. Thus, as the shaft 30 rotates the permanent magnet assembly 12 moves past a given point in timed relation to a physical position of the shaft driven by the engine. Preferably, rotation of the magnet assembly relative to the stator assembly 14 is in timed relation to the top dead center position of a piston within an engine cylinder to the control the timing of an ignition spark relative to the top dead center position of the piston. The timing of the ignition system 10 is controlled by circuitry on a printed circuit board 34 preferably carried by the stator assembly 14.

The magnet assembly 12 has a permanent magnet 36 disposed with its poles oriented to engage a pair of ferromagnetic pole pieces 38,40. Since the flywheel 28 is made of a non-magnetic material, such as aluminum, the magnetic flux emitted by the permanent magnet 36 will be concentrated in the pole pieces 38,40 for magnetic coupling to the core 21 of the stator as the permanent magnet 36 is rotated past the core 21.

As shown in FIG. 1, the stator assembly 14 is mounted adjacent to the flywheel 28 for communication with the permanent magnet assembly 12. The stator assembly 14 has a coil bobbin 42 with multiple compartments or bays in which the primary charge coil 18, secondary charge coil 16 and primary and secondary windings 44,46 of the ignition coil 20 are received. The core 21 has a bight or cross bar portion 48 interconnecting a pair of leg portions 50,52 extending towards the flywheel 28. The core 21 will generally have either two or three leg portions and, in any event, it is preferably of a multi-laminar construction of ferromagnetic material such as iron plates.

The coil bobbin 42 has a pair of spaced apart flanges 54 between which the primary charge coil 18 and secondary charge coil 16 are co-wound. For close magnetic coupling with the permanent magnet assembly 12, the primary charge coil 18 and secondary charge coil 16 are disposed adjacent to the flywheel 28 to be in close proximity to the permanent magnet assembly 12. The secondary winding 46 of the ignition coil 20 is wound between a set of closely spaced flanges 56. The primary winding 44 of the ignition coil 20 is received in a central compartment 58 of the bobbin 42 generally radially inwardly of and spaced from primary charge coil 18, secondary charge coil 16 and the secondary winding 46. The primary winding 44 of the ignition coil 20 is spaced from the primary charge coil 18 and the secondary charge coil 16 to minimize the magnetic coupling between them. The secondary winding 46 of the ignition coil 20 is fitted closely adjacent the primary winding 44 for maximum inductive coupling between the primary and secondary windings 44,46 and is connected to a spark plug 60 and ground 62 as shown in FIG. 2. As is conventional in the art, the various coils 16,18,20 and the circuit board 34 are disposed in a plastic cup-shaped housing 62 and are encapsulated in a suitable epoxy resin for moisture and weatherproofing, enhanced performance and maximum service life of the system.

At low engine speeds it is not advantageous and may be destructive to the engine starter to fire the spark plug 60 before the piston has passed its top dead center position. Combusting the fuel in the engine cylinder before the piston has reached top dead center can cause the piston to stop and possibly reverse direction. If this happens while the starter is engaged the starter may be damaged. To avoid this situation it is desirable to delay combustion until after the piston has passed top dead center. To ensure that this is the case, a separate sensor 64 is mounted angularity displaced from the primary charge coil 18 such that it creates an electrical signal or pulse 66 (FIG. 4A) after the piston has passed top dead center. This pulse 66 is communicated to a microprocessor 68 on the circuit board 34 where, at low engine rotary speeds, it is used to initiate the discharge of the ignition capacitor 24. A suitable, commercially available microprocessor is a Zilog Z86E08.

The sensor 64 is preferably carried by the stator assembly 14 spaced from the core 21 and detects the permanent magnet assembly 12 on the flywheel 28 as it rotates by the sensor 64. The sensor 64 may be a coil, hall effect, a magnetic restrictive or other magnetically sensitive material or device sufficient to generate a signal when the permanent magnet assembly 12 rotates past the sensor 64. The sensor 64 is preferably mounted on the circuit board 34 which has circuitry to receive the signal 66 generated by the sensor 64. Alternatively, the sensor 64 may be designed to use optical, mechanical or other means of detecting the position of the flywheel 28 or the shaft 30.

An energy storage device, such as a battery 22 and preferably a nickel cadmium battery, is located remotely from the stator assembly 14 and is connected to the circuit board 34 with a single wire. The second wire from the battery 22 is electrically connected to the frame of the engine which is connected to the ground 62 of the circuit board 34. Alternatively, the battery 22 can be mounted on or adjacent the stator assembly 14 and may have both of its wires connected to the circuit board 34.

The circuitry 74 of the circuit board 34, as shown in FIG. 2, has the ignition capacitor 24 which is selectively discharged to generate a spark across the gap 76 of the spark plug 60 when sufficient energy has been stored in the ignition capacitor 24. The discharge of the capacitor 24 is controlled relative to the speed of the engine by the microprocessor 68. Generally, a ceramic resonator 78 energized by the microprocessor 68 provides timing pulses to the microprocessor 68 which counts the pulses to determine or control the length of time for an event. Several capacitors 71, 73 and 75 act as signal filters and several resistors 77, 79 and 8 1 provide voltage dividers for various reference signals of the microprocessor 68.

For each revolution of the flywheel 28 and hence the permanent magnet assembly 12 past the core 21, a positive main pulse 80 and two, negative side pulses 82,84 of a smaller magnitude, as shown in FIG. 3A, will be generated in the primary charge coil 18. The main pulse 80 is rectified by diode 99 and is used to charge the capacitor 24. The two side pulses 82,84 are, with reference to ground, of positive potential as shown in FIG. 3B and are rectified by diode 98, charge capacitor 100 and through the connection at pin 102, turn on a voltage regulator 104 and are used to energize the microprocessor 68 and also to provide input reference signals 86,87 (FIG. 3C) for the microprocessor 68 which are formed by the diode 88, resistors 90 and 92 and capacitor 94.

At low engine speeds, such as below 700 rpm or some other speed based on system design tradeoffs, the primary charge coil 18, does not charge the ignition capacitor 24 to a sufficient level to provide enough energy to the primary winding 44 to ensure that a spark will be generated across the gap of the spark plug 60. To provide adequate energy to generate a spark at ultra low engine speeds, the secondary charge coil 16 is co-wound with the primary charge coil 18 to provide a magnetic transformer circuit 95. This transformer 95, in conjunction with a transistor 97, and the battery 22 is used to provide additional energy in the ignition capacitor 24 by switching the battery current to the secondary charge coil 16, on and off such that the ignition capacitor 24 is charged through diode 99 by the flyback voltage of the charge coil 16 which is generated when the battery current to the secondary charge coil 16 is switched off and which is transformer coupled to the primary charge coil 18. The transistor 97 controls the switching of the current on and off to the secondary charge coil 16 and is controlled by the microprocessor 68 through pin 17 and resistor 129. The ignition capacitor 24 is protected from over charging by diode 101.

During the 90 to 140 micro seconds that the transistor 97 is turned on, the voltage from the battery 22 causes a current to flow in the secondary charge coil 16. In one embodiment, this current reaches a maximum of from 1 to 4 amps. When the transistor 97 is turned off, the current to the secondary charge coil 16 is terminated. The voltage in the coil 16 increases proportionately with the rate of change in the current due to the collapse of the magnetic field around the coil 16 induced by the current. This collapsing magnetic field is also coupled into the primary charge coil 18 co-wound on the same bobbin and ferromagnetic core 21 and causes current to flow in the primary charge coil 18 through diode 99 to charge the ignition capacitor 24. The time that the transistor 97 is turned off must be sufficient for all of the available energy in the magnetic field to be transferred into the ignition capacitor 24, and this time actually gets shorter as the charge on the ignition capacitor 24 increases. On each successive cycle, the voltage on the ignition capacitor 24 is increased by a few volts. During typical operation of a particular embodiment of ignition system 10, it takes from 10 to 80 cycles to increase the energy stored in the ignition capacitor 24 to a level sufficient to ensure proper operation of the spark plug 60.

During the first revolution of the engine, this charging takes place when a leading edge 116 (FIG. 3C) of the first pulse 86 is detected and corresponds to the initial pulse block 96, as shown in FIG. 4A, which only occurs on the first revolution of the engine and which provides energy for an initial discharge of the capacitor. During subsequent revolutions, the charging (nominally indicated at block 103 in FIG. 4A) of the capacitor 24 by the secondary charge coil 16 begins immediately following discharge of the capacitor 24 and continues until the microprocessor 68 determines from the time between successive pulses 66 that the engine is rotating faster than a preprogrammed threshold speed that corresponds with the primary charge coil 18 alone generating sufficient energy to charge the ignition capacitor 24 and ensure a spark is generated across the gap at the spark plug 60 when the capacitor is discharged. Depending on system design, this threshold speed the engine is could be as low as 300 rpm or as high as 1500 rpm. At low engine rotary speeds, pulses 66 are used to time ignition to prevent ignition before the engine piston has top dead center which is undesirable as discussed above.

In addition to providing energy for the supplemental charging of the ignition capacitor 24, the battery 22 may also be used to provide power for other auxiliary functions of the engine or of the machine powered by the engine. Advantageously, the system may also recharge the battery 22. To minimize system cost and complexity the secondary charge coil 16 is used to recharge the battery 22 and desirably, the recharging function is not regulated and all excess power is directed into the battery 22 by a diode 136. Additionally, excess power from the primary charge coil 18 is directed through diode 110 to provide additional charging of the battery 22.

Figure 7:
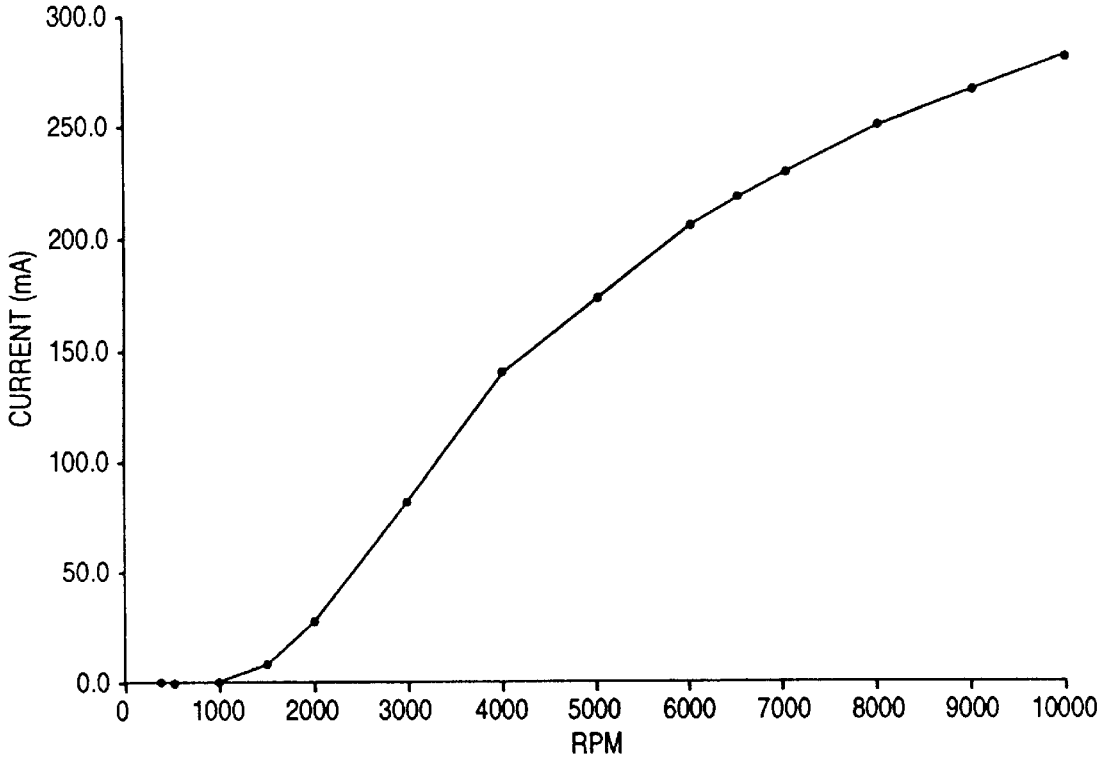
FIG. 7 is a plot of battery recharging current as a function of engine rotary speed.

The energy delivered to the battery is a function of engine speed. At low engine speeds the energy developed by the secondary charge coil 16 does not create a voltage greater that the battery voltage plus the forward voltage drop of the diode 136. At higher speeds the energy will be great enough that the diode 136 will be forward biased and current will begin to flow through the diode 136 and the battery 22. The engine speed at which this begins to happen is a function of the battery 22 charge state, the magnet assembly 12 strength, the gap between the pole pieces 38,40 and the core 21, the number of turns of the secondary charge coil 16, and the inductance of the charge coil and associated wiring. A representative graph of the charging current vs. engine rpm is shown in FIG. 7.

Operation

Upon initial cranking of the engine, as shown in FIGS. 4A, 4B and 4C, the first passing of the magnet assembly 12 by core 21 generates signal 86 which triggers the microprocessor 68 to generate a series of pulses 96 of sufficient quantity to initially charge the capacitor 24. A portion of the energy of the pulse 82 is conducted through a diode 98 to charge a capacitor 100 connected to a shutdown control pin 102 of a system voltage regulator 104. This turns the regulator 104 on to provide regulated voltage from the battery through a diode 106 which is filtered by a capacitor 108. As the engine rotary speed increases, the side pulses 82,84 from the primary charge coil 18 and also the adjacent secondary charge coil 16 increase in peak voltage. To provide the operating power for the system 10, when the peak voltage of the side pulses 82,84 increases to a level greater than the battery voltage plus the voltage drop across the diode 110, current flows from the primary charge coil 18 and secondary charge coil 16 into the capacitor 108. To conserve the battery power, a resistor 112 ensures that if pulses are no longer generated by the primary charge coil 18 and secondary charge coil 16, the voltage regulator 104 will be turned off at least in part to prevent unnecessarily draining the battery 22. Also, through a diode 114 the microprocessor 68 has the ability to keep the regulator 104 turned on to permit the microprocessor 68 to control the length of time that the voltage regulator 104 is kept on when the engine is running at very low speeds.

As shown in FIG. 4A, the pulses 66 derived from the sensor 64 as the permanent magnet assembly 12 rotates past the sensor 64 are timed to be at the proper point of engine rotation at which an ignition spark should be provided when the engine is rotating at a very low speed. During the first revolution of the engine the microprocessor 68 measures the time between leading edges of successive pulses 66. This time corresponds to the engine speed. Upon completion of the second revolution and until the completion of a revolution whose duration is shorter than a preprogrammed time, the engine speed is determined using this method of measuring the time between the pulses 66. When an engine revolution occurs having a duration less than the preprogrammed time, the ignition system 10 switches to a second method of measuring engine speed using the width of the first pulse 86 as discussed in greater detail below.

Figure 6:
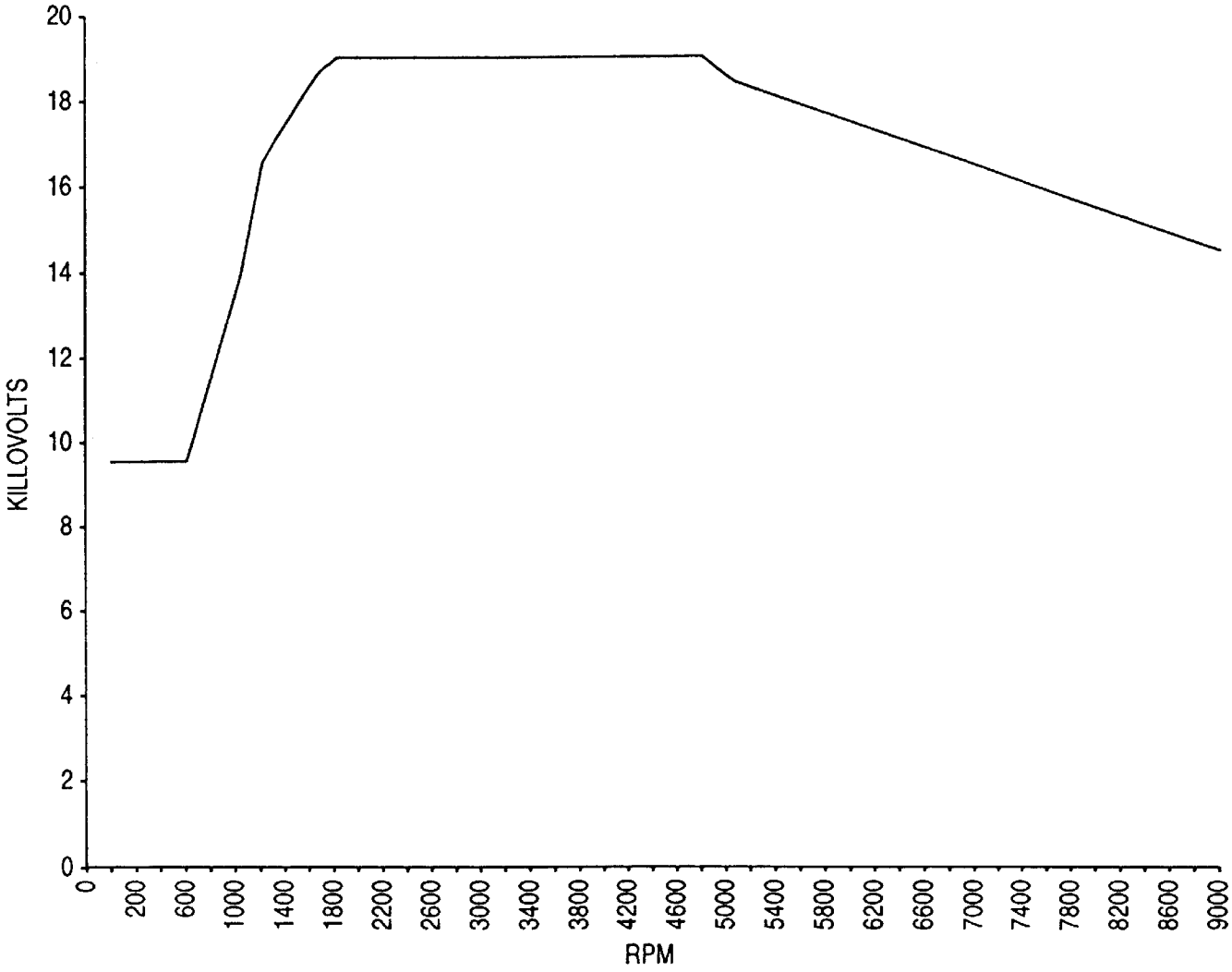
FIG. 6 is a plot of spark intensity as a function of engine rotary speed.

At higher engine speeds, timing pulses 120, as shown in FIG. 5A, are used in the microprocessor 68 and are counted between a leading edge 116 (FIG. 36) of the first pulse 86 (FIG. 36) and a trailing edge 118 of the first pulse 86 as generally indicated at 120. The width of the first pulse 86 is a function of the rotational speed of the engine shaft 30 and the flywheel 28 and the number of timing pulses counted by the microprocessor which occur during pulse 120 will be inversely proportional to the rotational speed of the engine. The timing pulse counts are used for establishing a timing reference used in the microprocessor 68 for controlling (advancing and retarding) the spark timing using programmed, or stored data, of the most efficient spark advances for various rotational speeds of the particular engine on which the system is to be used. Programmed in this way and based upon the actual engine rpm, the microprocessor 68 will output a control signal 122 which triggers an SCR 124 through the noise protection devices: diodes 126; capacitor 128; and resistor 130. Additional resistors 127, 129 and 131 act as a voltage divider to protect the gate of the SCR 124. When the SCR 124 is triggered by the control signal 122 it discharges the capacitor 24 through the primary winding 44 of the ignition coil 20 and thereby induces a current in the secondary winding 46 to generate a high voltage producing spark (nominally represented at 133 in FIGS. 4C and 5C) at the spark plug 60. A graph representing the maximum spark voltage as a function of engine rpm is shown in FIG. 6. The control signal 122 is timed for the most efficient spark ignition operation of the engine and is determined based on the width of the first pulse 86, and generated as a predetermined time delay 132 from a leading edge 134 of the second pulse 87 to the generated control signal 122.

When the microprocessor 68 determines from the width of the first pulse 86 that the engine rotational speed is above another much higher preprogrammed maximum engine rotary speed (such as 6,000 to 10,000 rpm) the control signal 122 to the ignition SCR 124 may be disabled so that the spark will not occur in order to provide over speed protection for the engine. This will cause the engine to slow down due to lack of power. On subsequent revolutions the microprocessor 68 will monitor the width of pulse 86 until it determines that the speed has been reduced to a level below this higher preprogrammed speed, it will then re-enable the output control signal 122 to fire the spark at the proper time. Pulses 86 are used at higher engine speeds as the pulses 66 from the sensor 64 occur too late at higher engine speeds to be useful.

If desired, an engine kill switch 140 may be connected to the circuit at terminal 142. When the kill switch 140 is closed by the operator all of the charging power that is normally supplied to the ignition capacitor 24 is shunted to the system ground 62. This prevents energy from being stored in the ignition capacitor 24 and subsequently being discharged through the primary winding 44 which in turn means that no spark will be generated. Lack of an ignition spark will prevent combustion and allow the engine system friction to bring the engine to a stop. If the operator releases the kill switch 140 before the engine has come to a complete halt the engine may continue to run. An option can readily be added to the kill function to kill the ignition until the engine has come to a complete stop.

What is claimed is:

1. A capacitor discharge ignition system for an internal combustion engine comprising:

a ferromagnetic core;

a primary charge coil on the core;

a permanent magnet rotatable by an engine to generate pulses in the primary charge coil;

an ignition coil having a primary winding and a secondary winding, the secondary winding being constructed to be connected across a spark plug;

a capacitor charged in part by the pulses in the primary charge coil;

a circuit for discharge of the capacitor through the primary winding;

an electronic control for controlling discharge of the capacitor;

a secondary charge coil on the core;

energy storage means for providing energy to the secondary charge coil; and an electronic switch for selectively providing current from the energy storage means to the secondary charge coil to charge the capacitor to increase the charge stored on the capacitor to facilitate starting the engine at relatively low engine rotary speeds.

2. The ignition system of claim 1 wherein the electronic control is a microprocessor.

3. The ignition system of claim 1 wherein the primary charge coil and the secondary charge coil are co-wound on the ferromagnetic core.

4. The ignition system of claim 1 wherein the energy storage means is a battery.

5. The ignition system of claim 4 which also comprises a diode which controls current flow from the secondary charge coil to the battery to recharge the battery only when the charge coil voltage is above a threshold value.

6. The ignition system of claim 1 wherein a flyback voltage is generated when the current to the secondary charge coil is switched off to increase the charge on the capacitor.

7. The ignition system of claim 1 which also comprises a sensor which senses the passing of the permanent magnet assembly through a particular position and provides a signal in response thereto, and at least at low engine rotary speeds, the signal is used to time discharge of the capacitor.

8. The ignition system of claim 7 wherein the sensor is located relative to the path of rotation of the permanent magnet assembly to provide a signal which is timed to prevent discharge of the capacitor before an engine piston has reached its top dead center position.

9. The ignition system of claim 1 which also comprises a voltage regulator in circuit with the energy storage means, having on and off states and being switchable to its off state when pulses are not generated in the primary charge coil.

10. The ignition system of claim 9 wherein the voltage regulator is turned on by a pulse generated by the passing of the permanent magnet assembly by the primary charge coil.

11. The ignition system of claim 1 wherein the electronic switch is a transistor which changes state in response to a signal from the electronic control.

* * * * *